United States Patent [19]

Wolfson et al.

[11] Patent Number: 5,020,405

[45] Date of Patent: Jun. 4, 1991

[54] APPARATUS WITH MOVEABLE PINS FOR SPREADING AND CUTTING LAYUPS OF SHEET MATERIAL

[75] Inventors: Lawrence S. Wolfson, West Hartford; Kevin A. Pearl, Manchester; Russell M. Moskwa, Mansfield Center, all of Conn.

[73] Assignee: Gerber Garment Technology, Inc., Tolland, Conn.

[21] Appl. No.: 525,870

[22] Filed: May 17, 1990

[51] Int. Cl.[5] ..... B26D 7/02

[52] U.S. Cl. ..... 83/374; 83/385; 83/451; 83/940; 269/54.5

[58] Field of Search ..... 83/374, 451, 939, 940, 83/941, 381, 384, 454, 456, 455, 62, 385; 269/21, 54.3, 54.4, 54.5, 54.1

[56] References Cited

U.S. PATENT DOCUMENTS

| | | | |
|---|---|---|---|
| 4,485,712 | 12/1984 | Gerber | 83/451 |
| 4,807,504 | 2/1989 | Vandermarliere | 83/451 X |
| 4,832,323 | 5/1989 | Principe et al. | 269/54.5 |

*Primary Examiner*—Frank T. Yost
*Assistant Examiner*—Kenneth E. Peterson
*Attorney, Agent, or Firm*—McCormick, Paulding & Huber

[57] ABSTRACT

In an apparatus for spreading and cutting layups of sheet material pin mechanisms are distributed over the supporting surface of the table and include pins moveable between raised and lowered positions to enable selected portions of the supporting surface to be adapted, or not, to a spreading procedure involving the pinning of each layer as it is spread. The supporting surface is divided into sections and the pin mechanisms of each section are operated in unison by a control element located on the side wall of the table with each control element being aligned with its associated section of the table so as to be quickly and easily operable by an operator without the operator having to give great thought or attention to which pin mechanisms are operated by which switch. The pins passing through a layup being cut by the cutter are automatically lowered upon the cutter approaching the pins to avoid collision between the pins and the cutter. This latter function can be defeated, if desired, to allow the cutter to be passed over a layup in a noncutting mode without pins being withdrawn from the layup.

12 Claims, 6 Drawing Sheets

APPARATUS WITH MOVEABLE PINS FOR SPREADING AND CUTTING LAYUPS OF SHEET MATERIAL

FIELD OF THE INVENTION

This invention relates to an apparatus for spreading and cutting layups of sheet material including a table with a material supporting surface and a plurality of pins distributed over at least a portion of the supporting surface and moveable between raised and lowered positions relative to the surface, the pins when raised being useful in enabling successive layers of a layup to be carefully registered with one another during the spreading process to cause stripes, plaids, or other patterns of the material to register with one another from layer to layer and to keep the layers from shifting relative to one another before and during cutting; and deals more particularly with such an apparatus wherein the pins of successive sections of the supporting table arranged next to one another along the length of the table may be easily selectively moved between their raised and lowered positions to adapt as much of the supporting surface as desired to a pin implemented spreading procedure and wherein during cutting of a pinned layup pins in the vicinity of the cutter are automatically lowered to avoid collision between the cutter and the pins.

BACKGROUND OF THE INVENTION

The apparatus of this invention is one including a table with a supporting surface useable for both the spreading and the cutting of layups of sheet material and which includes a plurality of pins distributed over all or at least a portion of the surface. When all of the pins are lowered the table may be used in a generally conventional manner for spreading and cutting single layers or layups of sheet material without pinning. However, when desired, the pins contained within a given area of the supporting surface may be raised to adapt that area to the spreading and/or cutting of a layup with the pins extending through the layers of the layup to hold them in strict registry.

the use of pins with spreading and cutting tables is well known in the art. It is also known to make such tables in a form whereby pins may be applied to or removed from different areas of the supporting surface to selectively adapt all or a given area of the table to either a pinning or a non-pinning procedure. For example, Japanese Utility Model Publication no. 27277/81 and Japanese Laid Open Patent Application No. 92469/89 both show tables including supporting surfaces having distributed holes into or from which needles may be manually placed or removed by hand. Further, Japanese Patent Publication No. 35306/86 and Japanese Utility Model Publication No. 717/83 both show tables having needles permanently associated therewith and distributed over the supporting surface which needles are moveable vertically between raised and lowered positions by pressure fluid actuators. In the devices of both of the latter publications, a separate witch controlling each fluid pressure actuator is provided on a switch panel so that the raising of the pins in a first area of the table and the lowering of the pins in a second area of the table to adapt only the first area to a pinning procedure requires a careful and time consuming setting of the individual pin controlling switches.

After a layup has been spread and pinned it is often desirable to maintain the pins in the layup during the cutting procedure to keep the layers from shifting relative to one another due to the forces imposed by the cutting tool. However, unless careful precautions are taken to see that no pins are located in the path of the cutting tool the danger exists that the cutting tool or the presser foot of the cutter will collide with one or more of the pins during a cutting procedure to damage the tool or otherwise prevent proper cutting.

The general object of the invention is therefore to provide a spreading and cutting apparatus of the foregoing character having a means whereby the provision or non-provision of raised pins in a given area of the supporting surface is quickly and easily controllable by an operator.

A further object of the invention is to provide a spreading and cutting apparatus of the foregoing character including a means for automatically lowering the pins in the vicinity of the cutter during a cutting procedure to enable the cutting of a pinned layup without danger of the pins interfering with the operation of the cutter.

Other objects and advantages of the invention will be apparatus from the following detailed description of a preferred embodiment of the invention and from the appended claims taken in conjunction with the accompanying drawings.

SUMMARY OF THE INVENTION

The invention resides in an apparatus for spreading and cutting layups of sheet material comprising a table with a top structure providing a generally upwardly facing supporting surface divided into a plurality of sections arranged next to one another longitudinally of the surface. Associated with each of the sections of the supporting surface is a plurality of pin mechanisms each including a generally vertical pin moveable between raised and lowered positions relative to the surface. A means is associated with the pins of each supporting surface section for raising and lowering the pins of that section in unison with such means including a manually operable control element located adjacent the operator's side of the table and in alignment with the associated supporting surface section. The control elements for the pins of the various table sections are therefore readily accessible to and operable by the operator with the operator having to pay little or no attention to which switch controls which pins and with the operator therefore being unlikely to make mistakes in the setting of the switches.

The invention further resided in the apparatus including an X-carriage extending transversely over the supporting surface and moveable longitudinally of the table and carrying a cutter moveable longitudinally of the carriage for cutting sheet material spread on the supporting surface, together with means responsive to the position of the carriage for automatically lowering raised pins in the vicinity of the carriage to avoid the possibility of the cutter striking any pins.

The invention still further resides in other details and features of the apparatus defined by the claims.

DETAILED DESCRIPTION OF THE PREFERRED EMBODIMENT

Figure 5:
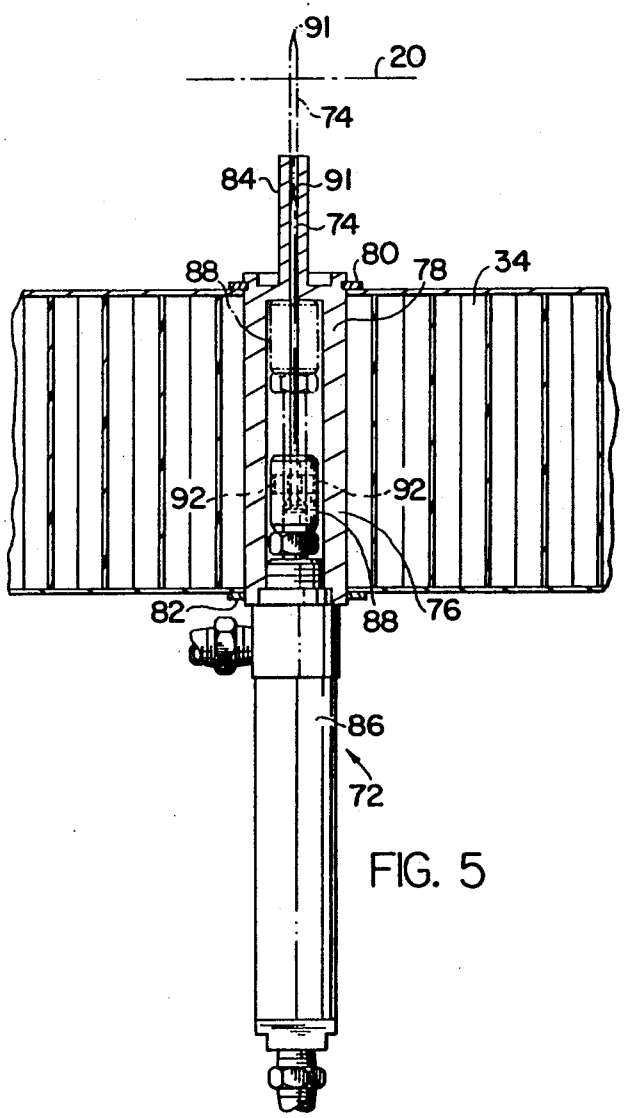
FIG. 5 is an enlarged view of one of the pin mechanisms of FIG. 3 with the pin guide portion thereof being shown in vertical section.

Referring first to FIGS. 1 to 4, an apparatus embodying the invention is there indicated generally at 10 and comprises a table 12 having a top structure 14 and a frame 16 for supporting the top structure at a convenient height from a floor 18. The top structure 14 provides an upwardly facing elongated supporting surface 20 for receiving and supporting one or more layups of sheet material, such as indicated at 22. For the cutting of layups received on the supporting surface the apparatus also includes a cutter 24 moveable in the illustrated Y-coordinate direction along the length of an X-carriage 26 extending transversely over the supporting surface 20 and supported on the opposite side edges 28 and 30 of the top structure for movement longitudinally of the supporting surface in the illustrated X-coordinate direction. Operation of the cutter during a cutting procedure is controlled in well known fashion by an associated numerical controller 32.

The particular construction of the table 12 and of its top structure 14 may vary widely without departing from the invention. In the illustrated case, however, the table and its top structure are taken to be generally similar to that shown in U.S. Pat. No. 4,768,763 to which reference may be made for further details. For the present purposes, and referring to FIGS. 3 to 4, it is sufficient to note that the top structure 14 comprises a horizontal panel 34 of sandwich construction, including a honeycomb core 36 and top and bottom metallic sheets 38. In addition to the honeycomb core, the panel also includes one or more, in the illustrated case two, vacuum ducts 40 of rectangular cross section each extending the full length of the table and positioned between the upper and lower sheets 38 of the panel. Each vacuum duct 40 is connected to a vacuum source 42 (FIG. 4) by suitable additional duct work 44. At regularly spaced locations along each vacuum duct 40 are openings or vacuum ports 46 each of which has associated with it a valve member 48 moveable between an open position as shown by the solid lines of FIG. 4 and a closed position as shown by the broken lines of FIG. 4.

Movement of each valve member 48 between its open and closed positions is effected by a single acting pneumatic actuator 50 including an internal valve actuated by a solenoid 52. Compressed air is supplied to each actuator by a supply line 54. When the solenoid 52 of each actuator 50 is energized the associated internal valve is positioned to disconnect the base of the actuator from the compressed air line 54 and to connect it to an exhaust port 56 so that an internal spring 58 holds the piston of the actuator in its lowered position corresponding to the open position of the valve member 48. When the solenoid 52 is deenergized the internal valve is shifted to connect the compressed air line 54 to the bottom of the actuator 50 and to disconnect the bottom of the actuator from the exhaust port 56 so that the compressed air applied to the bottom of the actuator moves the piston upwardly against the force of the spring 58 to move the valve member 48 to its closed position.

Supported on the upper metallic sheet 38 of the panel 34 is a grid structure having a large number of downwardly extending legs 59 spaced from one another and distributed over the entire extent of the supporting surface 20, with the legs being integral with and supporting a horizontal grid-like wall 60. The wall 60 has a large number of openings distributed over it to permit the free flow of air therethrough; and it serves to receive and support an overlying bristle bed 62 consisting of relatively closely packed vertically extending bristles the upper ends of which define the supporting surface 20. Preferably, the bristle bed 62 is made up of square or rectangular bristle blocks placed adjacent to one another to form the bed with each block having a horizontal base portion friction or snap fittedly assembled with the grid structure wall 60 and also having openings therethrough for the passage of air, with each bristle square or block having a large number of bristles extending upwardly from its base portion.

To allow vacuum to be applied to selected portions of the supporting surface 20 the supporting surface is divided into a number of individual rectangular areas 64 each serviced by a respective one of the vacuum ports 46. This division of the supporting surface into separate areas is accomplished by a barrier strip, shown at 66 in FIGS. 3 and 4 and indicated by the broken line of the same number in FIG. 2, extending the full length of the table, and by a plurality of similar barriers strips extending transversely of the table as indicated by the broken lines 68 of FIG. 2. In the following discussion and claims it is taken that the transverse barrier strips 68 divide the supporting surface 20 into a plurality of surface sections 70 arranged next to one another along the length of the supporting surface and that the longitudinally extending barrier strip 66 divides each of these surface sections approximately in half to define two individual areas 64. Thus, as seen in FIG. 2, the individual areas 64 may be viewed as being arranged in rows extending transversely of the supporting surface with each row containing two individual areas and as also being arranged in two columns extending longitudinally of the table.

Figure 1:
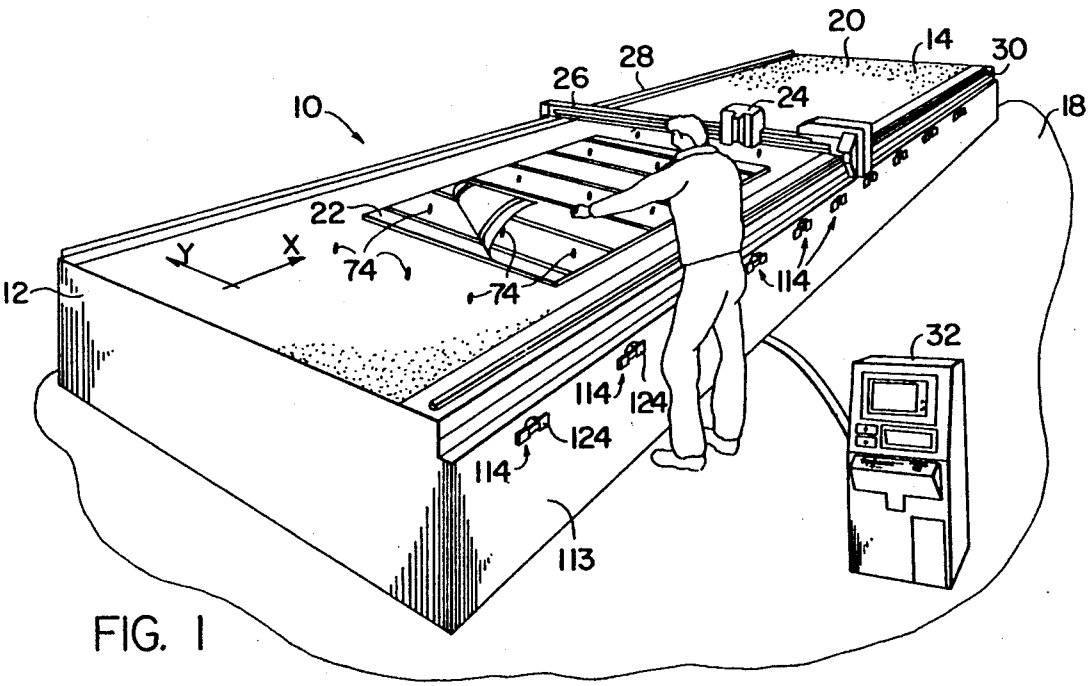
FIG. 1 is a perspective view of a spreading and cutting apparatus embodying the invention.
Figure 3:
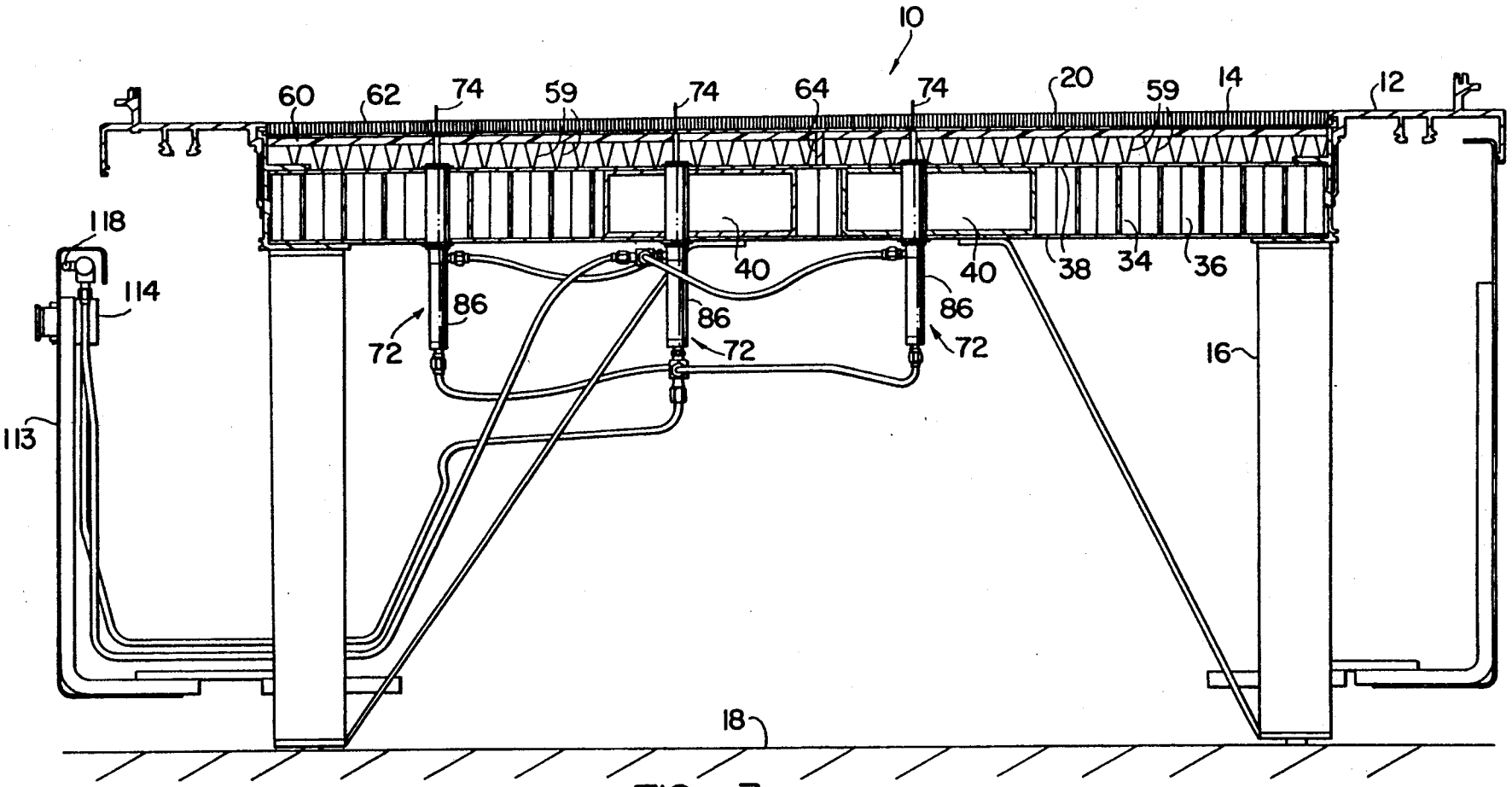
FIG. 3 is a vertical sectional view taken through the apparatus of FIG. 1 on the line 3—3 of FIG. 2.
Figure 4:
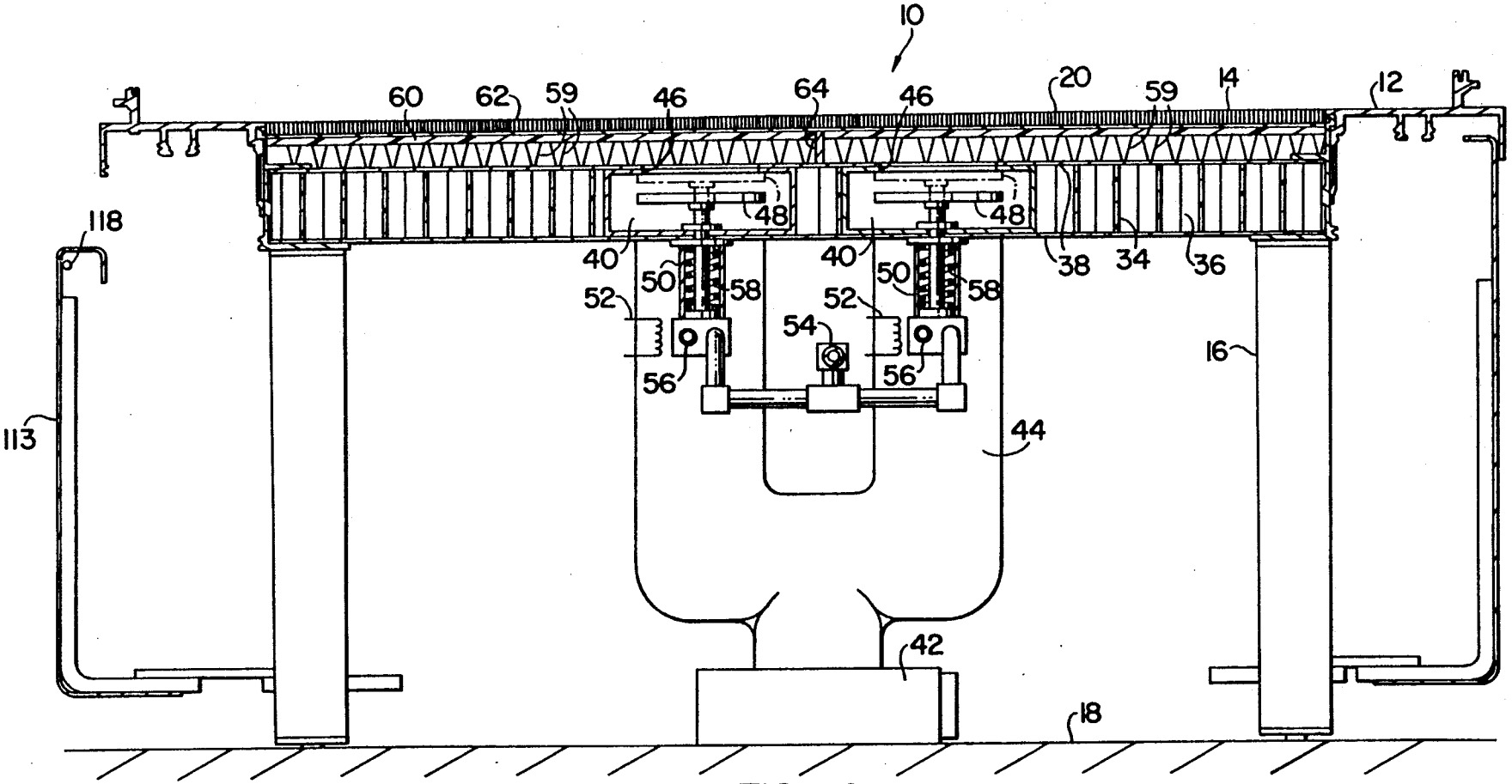
FIG. 4 is a vertical sectional view taken through the apparatus of FIG. 1 on the line 4—4 of FIG. 2.

In accordance with the invention, the table 10 includes a number of pin mechanisms distributed over all or at least a significant part of the supporting surface 20. Each of these mechanisms includes a pin moveable between raised and lowered positions relative to the supporting surface to aid, when raised, in the spreading and holding of layers of sheet material used to make a layup 22. Referring to FIGS. 1, 3 and 5, the pin mechanisms are indicated generally at 72 and their pins at 74. Each mechanism, as seen best in FIG. 5, includes a pin guide member 76 having a cylindrical body 78 passing through the table panel 34 and fixed to the panel by an upper snap ring 80 and a lower friction fit retaining ring 82. Extending upwardly from the body 78 is a needle guide bushing 84. Threadably connected to the bottom of the body 78 is a double acting pneumatic actuator 86. The free end of the piston rod of the actuator extends into the bore of the body 78 and is threadably connected with a needle holder 88. The bottom end of the needle 74 extends into a vertical central opening in the holder 88 and is held to the holder by two set screws 92. The solid lines of FIG. 5 show the parts in the positions occupied when the piston of the actuator is in its lowermost position, the upper point 91 of the needle at this time being located below the supporting surface 20 and within the bore of the bushing 84. The broken lines of FIG. 5 show the parts in the positions occupied when the piston of the actuator is in its uppermost position with the upper end of the needle at this time protruding upwardly beyond the supporting surface 20.

Figure 2:
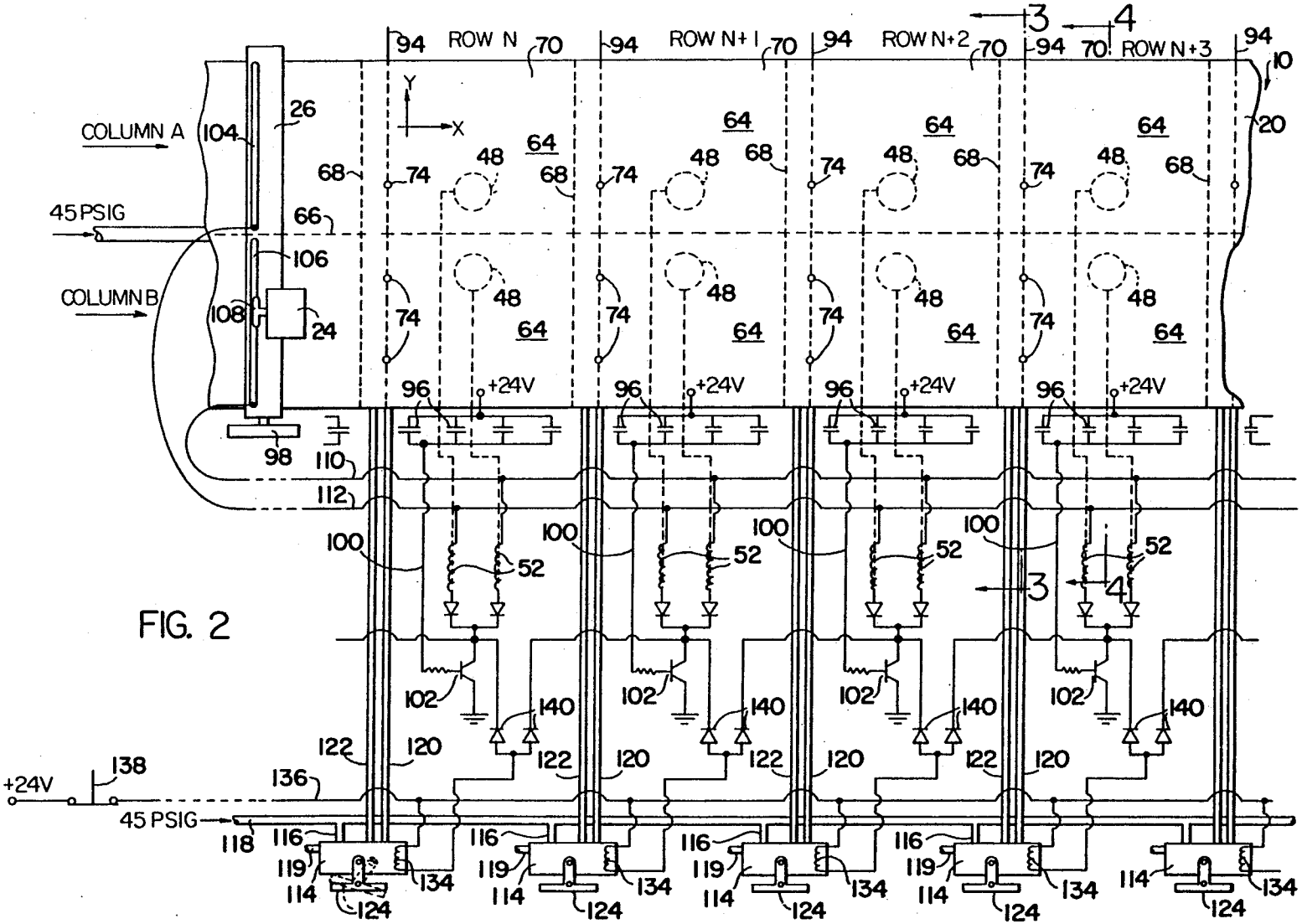
FIG. 2 is a view showing in plan a portion of the supporting surface of the FIG. 1 apparatus and showing schematically related portions of the control circuits for the pin mechanisms and vacuum valves.

The controls for operating both the vacuum valves 48 and the pin mechanisms are shown in FIG. 2. From this figure it will be observed that a given number of pin mechanisms are associated with each of the supporting surface sections 70. The number of pin mechanisms devoted to each surface section and their arrangement within each section may vary widely without departing from the invention In the illustrated case, each section is shown to include three pin mechanisms 72 all located along a common line 94 extending transversely of the supporting surface.

Arranged along one side edge of the supporting surface are a plurality of two-state electrical switches 96 spaced from one another along the length of the supporting surface at approximately regular increments. Each switch has a normal state and an operated state and is adapted to be switched from its normal state to its operated state when the X-carriage 26 is positioned at approximately the same position along the length of the supporting surface as the switch. Various different types of switches may be used, but preferably and as illustrated they are each a reed switch operated by a magnet 98 carried by the X-carriage 26. The contacts of each switch are normally open and are closed when the switch becomes aligned with the magnet 98. The magnet 98 has such a length relative to the spacing of the switches 96 that for all positions of the X-carriage longitudinally of the supporting surface 20 at least one, or preferably two or three, of the switches are closed by the magnet 98.

As shown in FIG. 2, each surface section 70 has associated with it four switches 96 connected together in parallel so that one contact of each switch is connected to a source of positive voltage and the other contact is connected through a line 100 to the base of an NPN switching transistor 102, the emitter terminal of which is grounded and the collector terminal of which is connected to one end of each of the two solenoids 52 associated with the two pneumatic actuators 50 of the two vacuum valves 48 of the associated surface section 70.

The opposite end of each of the two solenoids 52 associated with each surface section 70 is connected or not with a source of positive voltage depending on the position of the cutter 24 along the length of the X-carriage 26. In the illustrated case the carriage 26 includes two elongated contact strips 104 and 106 and the cutter carries a sliding contact 108 connected to a source of positive voltage. When the cutter 21 is positioned as shown in FIG. 2 the sliding contact 108 contacts the contact strip 106 to supply positive voltage to the line 110 feeding those solenoids 52 associated with the valves 48 of the surface areas 64 of column B. Similarly, when the cutter 24 is positioned on the X-carriage 26 so as to be aligned with the surface areas 64 of column A, contact of the sliding contact 108 with the contact strip 101 supplies positive voltage to the line 112 feeding those solenoids 52 associated with the vacuum valves 48 of column A. The sliding contact is of such length that when the cutter is positioned between column A and column B it will contact both of the contact strips 104 and 106 to supply positive voltage to all of the solenoids 52,52.

From the aforegoing, it will therefore be appreciated that due to closure of one or more of the switches 96 associated with each surface section 70 when the X-carriage is located within or near that section 70, one or the other or both of the vacuum valves 48 associated with that section will be opened depending on the position of the cutter 24 along the length of the X-carriage 26. Thereby it is assured that vacuum is applied to the particular individual area 64 over which material is being cut by the cutter at the moment, the vacuum in turn being useful in well known manner, with or without a sheet of air impermeable material overlying the layup, to compress and/or hold the layup to the supporting surface during the cutting procedure.

Figure 6:
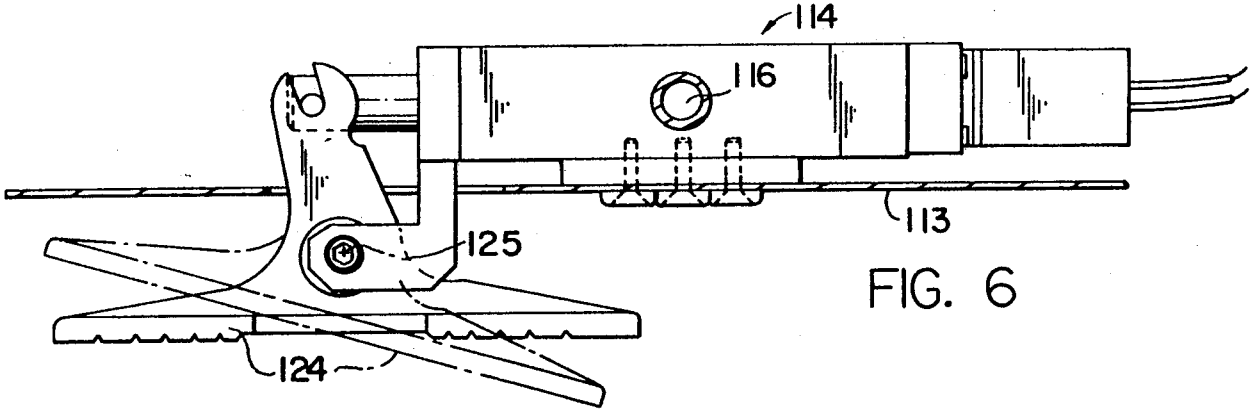
FIG. 6 is a plan view of one of the pin control valves of FIG. 1.
Figure 7:
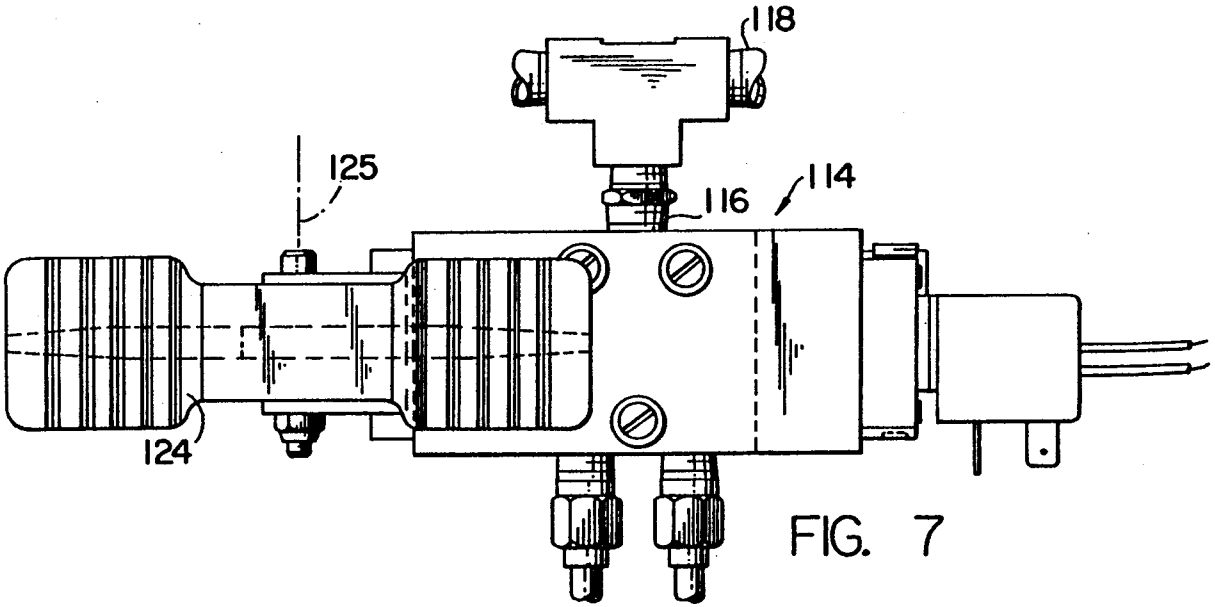
FIG. 7 is a side view of the valve of FIG. 6.
Figure 9:
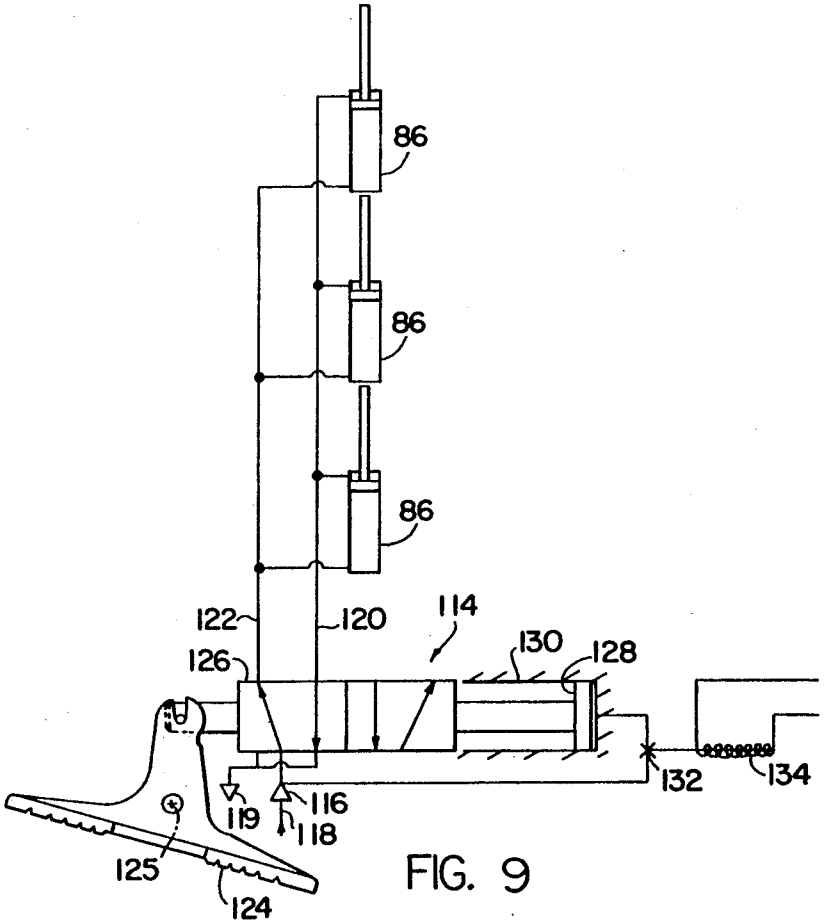
FIG. 9 is a view similar to FIG. 8, but with the valve set to the position corresponding to the raised positions of the associated pins.
Figure 8:
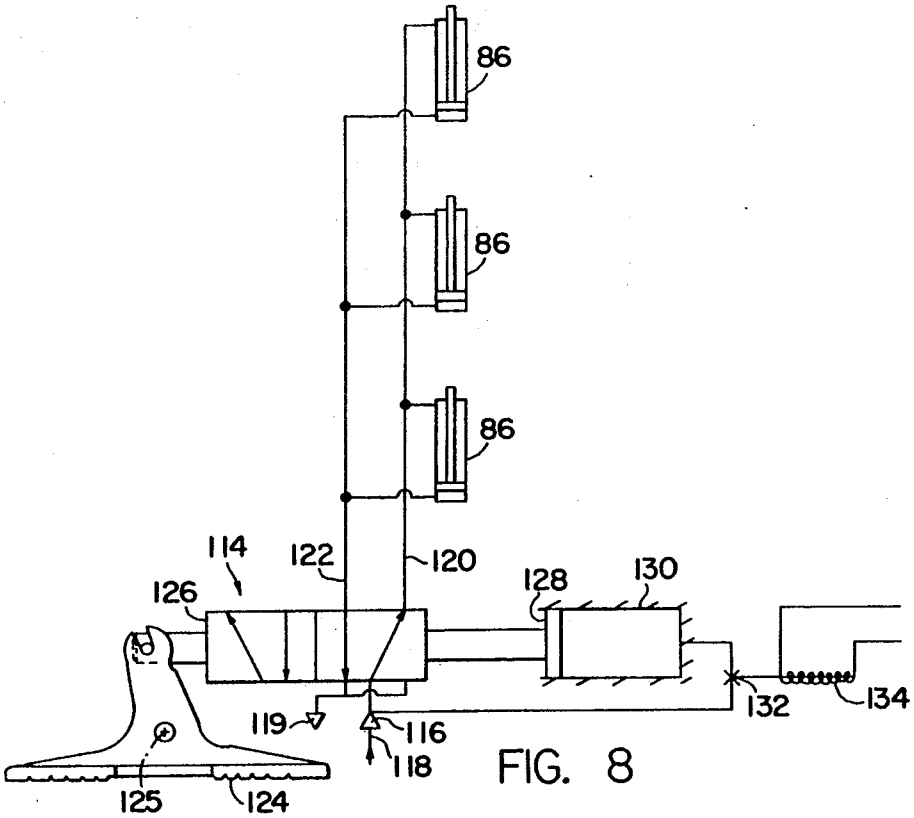
FIG. 8 is a schematic diagram of one of the pin control valves of FIG. 1 and of the pin mechanisms controlled thereby, with this view showing the valve set to the position corresponding to the lowered positions of the associated pins.

In further accordance with the invention, the pin mechanisms associated with a given section 70 of the supporting surface are operated in unison by a control element arranged on the operator's side of the table, located in alignment with the involved surface section, and preferably located on the side wall 113 of the table so as to be operable by the operator's leg or knee. Referring to FIGS. 1, 2 and 3 the illustrated control elements are valves indicated at 114. Each valve 114 has an inlet port 116 connected to a line 118 supplying pressurized air and also has an exhaust port 120 (not shown in FIGS. 6 and 7). Each valve also has two operating ports one of which is connected bY a line 119 to the rod ends of the three pin mechanism actuators 86 associated with the valve and the other of which is connected by a line 122 to the base ends of the three associated actuators 86. Each valve includes a T-shaped operating lever 124 pivotal between two positions about a vertical axis 125. Inside the body of each valve is a shuttle element, indicated schematically at 126 in FIGS. 8 and 9. In one position of the operating lever 124 the shuttle member 126 is positioned as shown in FIG. 8 to connect the base ends of the associated actuators 86 to exhaust and to connect the rod ends of the actuators to the pressure line 118 whereby holding the pistons of the actuators and the associated pins in their lowered positions. In the other position of the operating lever 124, as shown by FIG. 9, the shuttle member 126 of the valve 114 is positioned so that pressurized air from the line 118 is supplied to the base ends of the associated cylinders while the rod ends of the cylinders are connected to the exhaust port 120, thereby holding the pistons of the actuators and the associated pins in their raised positions.

Therefore, it will be understood that by merely moving the operating lever 124, which he can do with his leg or knee, the operator can switch the pins of a given surface section between their raised and lowered positions. Furthermore, the operating lever 124 of each valve is located in line with, that is in substantially the same vertical plane as, the pins controlled by the lever. Thus, when an operator stands in front of a given row of pins he can readily change the position of those pins by operating the operating lever immediately in front of him which he can find by feeling with his leg or knee without having to divert his eyes from the supporting surface.

The ability to raise or lower the pins of the various supporting surface sections by operating the operating levers 124 located on the side wall 113 of the table allows an operator to quickly and easily raise the pins of some surface sections and to lower the pins of other surface sections to adapt the supporting surface to a given job or jobs at hand.

A further feature of the invention is that if a layup is to be cut by the cutter 24 with the layup remaining pinned during cutting, during the cutting the pins in the vicinity of the cutter are withdrawn to avoid collision between the cutter and the pins. For this purpose each valve 114 is adapted to be switched from the raised pin state of FIG. 9 to the lowered pin state of FIG. 8 upon the appearance of an electrical signal resulting from the closure of an associated one of the switches 96. As shown schematically in FIGS. 8 and 9, the means for so shifting the valve 114 includes an internal piston connected to the shuttle element 126 and moveable in a cylinder 130. The base end of the cylinder is connected to the inlet port 116 through a normally closed valve 132 operated by a solenoid 134. When the solenoid 134 is deenergized the valve 132 is closed, and when the solenoid 134 is energized the valve 132 is open. If at the time the valve 132 is opened the shuttle element 126 and piston 128 are in the positions shown in FIG. 9 pressurized air admitted to the cylinder 130 by the opening of the valve 132 drives the piston 128 to the left to shift the valve to the condition of FIG. 8, thereby lowering the associated pins.

As shown in FIG. 2 one side of each solenoid 134 is connected to a line 136 connected through a normally closed switch 138 to a source of positive voltage. The other side of each solenoid 134 is connected through two steering diodes 140 to the collector of transistor 102 of the surface section 70 with which the valve 114 is associated and to the collector of the transistor 102 of the next adjacent section. Therefore, it will be understood that is the X-carriage 26 moves into or approaches a given surface section 70 the valve 114 of that section is driven to its pin lowered state, through the closure of one or more of the switches 96 by the magnet 98, to assure the presence of no pins in the area of the layup being cut by the cutter 24.

At times during the laying up of one or more layups on the supporting surface 20 it may be desired to move the X-carriage over the layup or layups in a noncutting mode without retracting pins from the layup or layups. This is accomplished in the circuit of FIG. 2 by opening the switch 138 Which prevents energization of the valve solenoids 134 and thereby defeats the automatic lowering of the pins in response to the position of the X-carriage.

We claim:

1. In an apparatus for spreading and cutting layups of sheet material, the combination comprising:

a table having a top structure providing a generally upwardly facing supporting surface and having first and second side edges extending longitudinally of the table, said supporting surface consisting of a plurality of surface sections arranged next to one another along the length of said supporting surface, a plurality of pin mechanisms associated with each of said surface sections, the pin mechanisms of each surface section being operable independently of the pin mechanisms of other surface sections, each of said pin mechanisms including a generally vertical pin with a pointed upper end portion and which pin is moveable vertically between a raised position at which said upper end portion extends upwardly from said supporting surface and a lowered position at which said upper end portion is located entirely below said supporting surface, and means for moving the pins of the plurality of pin mechanisms of each surface section in unison between their raised and lowered positions,. said means including a manually operable control element located adjacent said first side edge of said tabletop structure.

2. The combination defined in claim 1 further characterized by said table structure including a generally vertical side wall extending downwardly from said first side edge of said top structure, each of said control elements having an operating member located adjacent said side wall.

3. The combination defined in claim 2 further characterized by said table including a frame for supporting said top structure with said supporting surface at a given heighth from a floor, said operating members of said control elements when said frame of said table is placed on a floor being located at such a heighth from said floor as to be operable by a knee or leg of an operator.

4. The combination defined in claim 1 further characterized by said pin mechanisms associated with each of said surface sections being located on and spaced along a line extending transversely of said supporting surface, and said control element of each supporting surface section being located in substantially the same vertical plane as said line along which the associated ones of said pin mechanisms are located.

5. In an apparatus for spreading and cutting layups of sheet material, the combination comprising:

a table having a top structure providing a generally upwardly facing supporting surface and having first and second side edges extending longitudinally of the table, said supporting surface consisting of a plurality of surface sections arranged next to one another along the length of said supporting surface, a plurality of pin mechanisms associated with each of said surface sections, each of said pin mechanisms including a generally vertical pin with a pointed upper end portion and which pin is moveable vertically between a raised position at which said upper end portion extends upwardly from said supporting surface and a lowered position at which said upper end portion is located entirely below said supporting surface, means for moving the pins of the plurality of pin mechanisms of each surface section in unison between their raised and lowered positions, said means including a manually operable control element located adjacent said first side edge of said table-top structure, an X-carriage extending transversely over said supporting surface and moveable longitudinally thereof, a cutter supported on said X-carriage and moveable longitudinally of said X-carriage for cutting sheet material spread on said supporting surface, and means responsive to the position of said X-carriage longitudinally of said supporting surface for causing the pins of the pin mechanisms located in the vicinity of said X-carriage to be moved to their lowered positions so that during cutting of sheet material spread on said supporting surface by said cutter the possibility of said cutter striking any of said pins is avoided.

6. The combination defined in claim 5 further characterized by means for disabling said means for moving said pins in the vicinity of said X-carriage to their lowered positions to permit said X-carriage to be moved over material spread on said supporting surface with said cutter in a noncutting mode and without any of said pins of said pin mechanisms being lowered in response to the position of said X-carriage longitudinally of said table.

7. The combination defined in claim 5 further characterized by said means for operating said pin mechanisms in response to the position of said X-carriage longitudinally of said supporting surface including a plurality of two state switches located at spaced positions along the length of said supporting surface, and a means carried by said carriage for operating one or more of said switches located in the vicinity of said X-carriage, said switches being normally in one state and being switched to their other state when operated by said means carried by said X-carriage, and means responsive to said switches for moving to their lowered positions the pins of those pin mechanisms located generally in the same position longitudinally of said supporting surface as the operated ones of said switches.

8. The combination defined in claim 6 further characterized by each of said surface sections having associated with it a vacuum means for producing a vacuum over at least one individual area of said section, said vacuum means including a vacuum source, and a valve means connecting each of said individual areas to said vacuum source, and means for controlling the operation of said vacuum valves in response to the position of said X-carriage longitudinally of said table.

9. The combination defined in claim 8 further characterized by said means for operating said pin mechanisms and said vacuum valves in response to the position of said X-carriage longitudinally of said supporting surface including a plurality of two-state switches located at spaced positions along the length of said supporting surface, and a means carried by said X-carriage for operating one or more of said switches located in the vicinity of said X-carriage, said switches being normally in one state and being switched to their other state when operated by said means carried by said X-carriage, and means responsive to said switches for moving to their lowered positions the pins of those pin mechanisms located generally in the same position longitudinally of said supporting surface as the operated ones of said switches and for moving to its open position the vacuum valve of at least one of said individual areas located generally at the same position longitudinally of said supporting surface as the operated ones of said switches.

10. The combination as defined in claim 9 further characterized by said plurality of pin mechanisms associated with each of said surface sections being located on and spaced along a line extending transversely of said supporting surface.

11. In an apparatus for spreading and cutting layups of sheet material, the combination comprising:

a table having a top structure providing a generally upwardly facing supporting surface, a plurality of pin mechanisms distributed over at least a portion of said suPPorting surface, each of said pin mechanisms including a generally vertical pin with a pointed upper end portion and which pin is moveable vertically between a raised position at which said upper end portion extends upwardly from said supporting surface and a lowered position at which said upper end portion is located entirely below said supporting surface, an X-carriage extending transversely over said supporting surface and moveable longitudinally thereof, a cutter supported on said X-carriage and moveable longitudinally of said X-carriage for cutting sheet material spread on said supporting surface, and means responsive to the position of said X-carriage longitudinally of said supporting surface for causing the pins of the pin mechanisms located in the vicinity of said X-carriage to be moved to their lowered positions so that during cutting of sheet material spread on said supporting surface by said cutter the possibility of said cutter striking any of said pins is avoided.

12. The combination defined in claim 11 further characterized by said means for operating said pin mechanisms in response to the position of said X-carriage longitudinally of said supporting surface including a plurality of two-state switches located at spaced positions along the length of said supporting surface, and a means carried by said carriage for operating one or more of said switches located in the vicinity of said X-carriage, said switches being normally in one state and being switched to their other state when operated by said means carried by said X-carriage, and means responsive to said switches for moving to their lowered positions the pins of those pin mechanisms located generally in the same position longitudinally of said supporting surface as the operated ones of said switches.

* * * * *